US006203028B1

(12) United States Patent
Kress

(10) Patent No.: US 6,203,028 B1
(45) Date of Patent: Mar. 20, 2001

(54) MULTIPLE BLADE SKATE

(76) Inventor: Joseph M. Kress, 3621 Anne Marie Dr., Erie, PA (US) 16506

( * ) Notice: Subject to any disclaimer, the term of this patent is extended or adjusted under 35 U.S.C. 154(b) by 0 days.

(21) Appl. No.: 09/123,867

(22) Filed: Jul. 28, 1998

(51) Int. Cl.[7] ..... A63C 1/30
(52) U.S. Cl. ..... 280/11.12; 280/11.18
(58) Field of Search ..... 280/11.12, 11.14, 280/11.15, 11.17, 11.18, 11.19, 28, 28.15, 811; 36/115

(56) References Cited

U.S. PATENT DOCUMENTS

| | | | | |
|---|---|---|---|---|
| 150,896 | * | 5/1874 | See | 280/11.17 |
| D. 373,807 | * | 9/1996 | Swande | D21/225 |
| 539,641 | * | 5/1895 | Parkhurst | 280/11.12 |
| 1,499,448 | * | 7/1924 | Crawford | 280/11.17 |
| 1,996,925 | * | 4/1935 | Kaub | 280/11.17 |
| 2,216,438 | * | 10/1940 | Hamilton | 280/11.12 |
| 2,920,897 | * | 1/1960 | Jensen | 280/11.12 |
| 3,181,879 | * | 5/1965 | Hodges | 280/11.12 |
| 4,314,708 | * | 2/1982 | Zuuring | 280/11.18 |
| 4,392,658 | * | 7/1983 | Redmond et al. | 280/11.18 |
| 5,161,810 | * | 11/1992 | DeCesare | 280/14.2 |
| 5,456,495 | * | 10/1995 | McLeod | 280/811 |
| 5,570,893 | * | 11/1996 | Swande | 280/11.18 |

FOREIGN PATENT DOCUMENTS

72925 * 12/1947 (NO) .

* cited by examiner

*Primary Examiner*—Lanna Mai
*Assistant Examiner*—Christopher Bottorff
(74) *Attorney, Agent, or Firm*—Richard K. Thomson

(57) ABSTRACT

Skates having increased lateral stability for use in speed skating and hockey. A primary blade is provided with first and second secondary blades which extend laterally outwardly from the primary blade at angles therefrom. In a first preferred embodiment, these secondary blades extend outwardly at equal 45° angles and engage the surface of the ice when the primary blade tilts either direction through an angle of 45°. In a second preferred embodiment, the inner secondary blade extends outwardly at a lesser angle of say 30° so that double blade engagement of the ice can be more easily accomplished for sprinting situations.

14 Claims, 3 Drawing Sheets

MULTIPLE BLADE SKATE

The present invention is directed to an ice skate. More particularly, the present invention is directed to a multiple-blade skate which may be used in hockey or speed skating, for example, to increase stability.

BACKGROUND AND SUMMARY OF THE INVENTION

Every few years, the world is reminded how slippery ice is when several contestants in speed skating at the Winter Olympics wipe out and go skidding into the wall of the ice rink. The bottom line is that the skate slipped sideways on the ice and sent the skater sprawling. A more technical analysis is that the skate blade formed an angle with the surface of the ice which was too severe, taking into consideration the mass of the skater, the speed going into the turn, and the position of the skater's center of gravity, so that the coefficient of lateral sliding friction of the skate blade relative to the ice was insufficient to maintain the skater erect resulting in a fall.

In a separate venue, ice hockey players also battle the slipperiness of the ice. Most notably, when sprinting to/with the puck on a breakaway, for example, the player will roll her/his ankles in, laying the blade toward flat in order to dig the blades into the ice, so that s/he can push outwardly and back in an attempt to out sprint her/his opponent to the puck or goal. This attempt to increase traction for sprinting can actually result in slipping should the player be unsuccessful in sticking the blade deeply enough into the ice.

The present invention seeks to provide a remedy for this slippage. The ice skates of the present invention comprise a pair of skate blade assemblies, each assembly including a blade support to which a primary blade and a pair of secondary blades are attached, the primary blade having a first mean blade thickness and a first height, first and second secondary blades which each have a second mean blade thickness substantially equal to said first mean blade thickness, said first and second secondary blades each extending angularly outwardly from opposing sides of said primary blade at first and second predetermined angles; means to attach a pair of said blade assemblies to right and left feet of a wearer, respectively; whereby when one of said primary blades of said pair is in contact with and extends at a third or fourth predetermined angle with an ice surface, either said first or said second secondary blade will come in contact with said ice surface and provide auxiliary support, significantly reducing a risk of falling as a result of said primary blade slipping laterally on the ice surface. The preferred value for each of the first, second, third and fourth predetermined angles is 45°, such that when the skater's primary blade is at 45° with the ice and s/he would be at risk of losing sufficient frictional force to remain upright, the secondary blade will a) be vertical, in optimum position to support the skater's weight, b) provide additional resistance to lateral slippage, and thereby, c) avoid a spill. Further, for the hockey player, having two blades on each skate which can dig into the ice in a sprint situation will provide a decided advantage over a single blade skater.

While the design is simplified by having the secondary blades extend at equal 45° angles, some applications may dictate that the inner secondary blade engage the ice at a different angle than the outer secondary blade. For example, on the hockey skate, it may be advantageous to position the inner secondary blade in such a manner that it will engage the ice at an angle of 30° so that the skater need not roll her/his ankles in so far in order to get two blade engagement during a scramble for the puck. The outer secondary blade could remain at the 45° position for stability purposes. The inner blade could be made to engage the ice at an angle of 30° by changing the angle it forms with the primary blade to 30° and/or extending its length.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1:
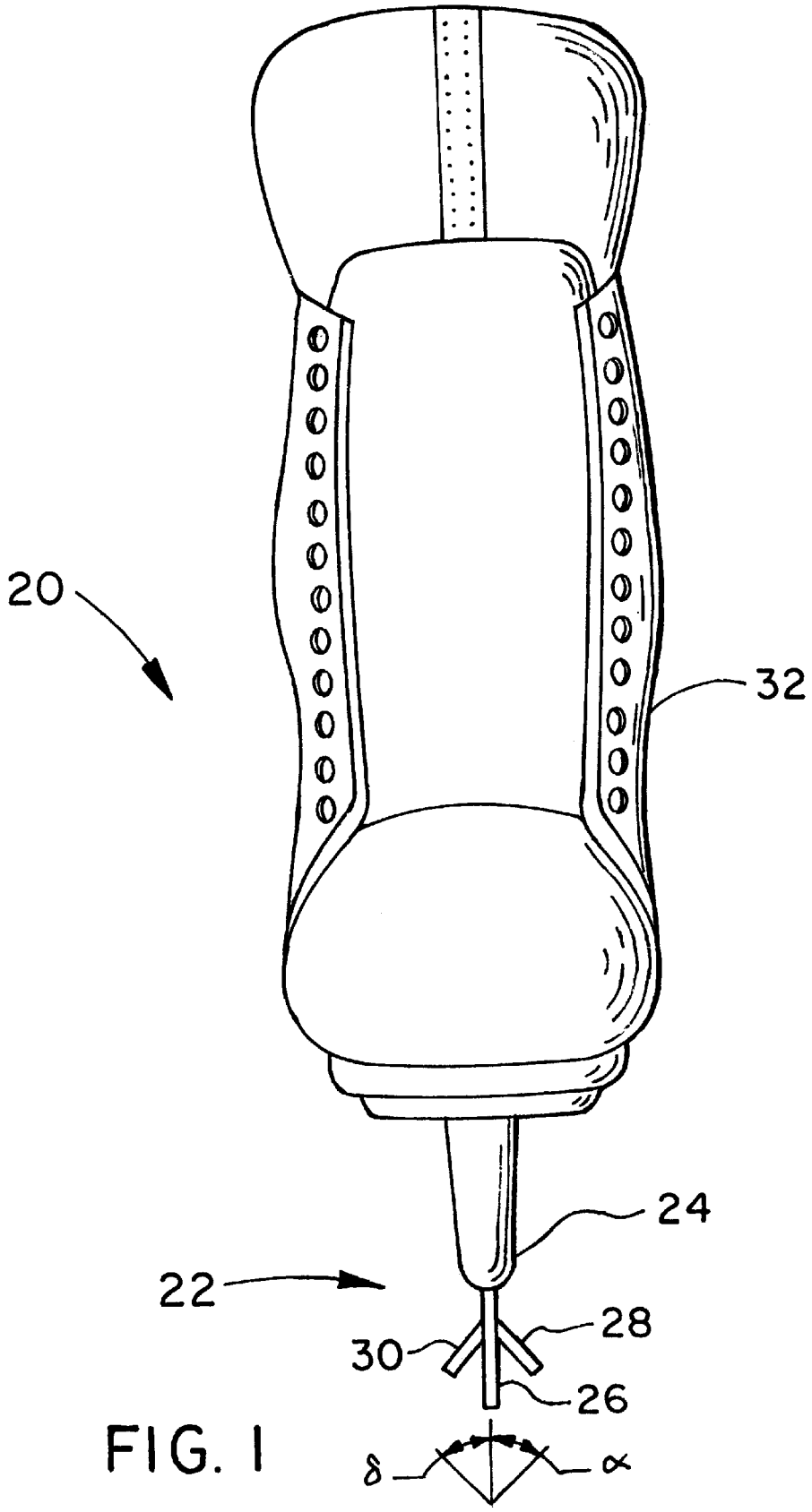
FIG. 1 is a front view of a first embodiment of the multiple-blade skate of the present invention.
Figure 3A:
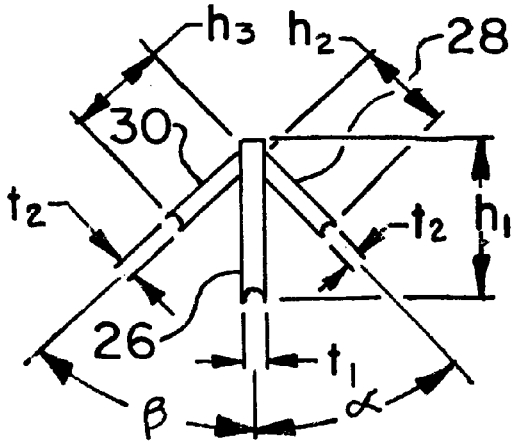
FIG. 3A is a front view of the blade configuration of the first embodiment.

A first embodiment of the multiple-blade skate of the present invention is shown in FIG. 1 generally at 20. Pairs of skates 20 are manufactured in left and right shoe versions but only the right shoe is shown in the figures. It will be understood that the left skate is merely a mirror image of its right counterpart. Skate 20 includes a blade assembly 22 which is made up of a blade support 24, a primary blade 26 and a pair of secondary blades 28 and 30. Primary blade 26 has a first mean blade thickness $t_1$ and a first mean blade height $h_1$ (FIG. 3A). The blade may vary slightly in thickness and height over its length but the terms "mean blade thickness" and "mean blade height" describe the average blade thickness and height, respectively. Means 32 is provided for attaching blade assemblies 22 to the wearer's feet are provided, preferably in the form of attached laceable shoes.

Secondary blades 28 and 30 each have a second mean blade thickness $t_2$ which is substantially equal to $t_1$ of primary blade 26 and second and third blade heights $h_2$ and $h_3$, respectively, that in the first preferred embodiment are substantially the same for each of the secondary blades 28 and 30. First and second secondary blades 28 and 30 extend angularly outwardly from primary blade 26 in opposite directions at predetermined first ($\alpha$) and second ($\beta$) angles (FIG. 3A). These secondary blades 28 and 30 will engage the ice when the axis of skate 20 and hence, primary blade 26, is tilted relative to the ice at a third ($\gamma$) or fourth ($\delta$) predetermined angle. In the first preferred embodiment, $\alpha$, $\uparrow$, $\gamma$, and $\delta$ are all equal to 45°. When the plane of the skate is tilted through an angle $\gamma$ or $\delta$ of 45°, one of secondary blades 28, 30, respectively, will come into contact with the ice. This will provide two benefits. It will stabilize the skate against impending slippage on the ice for both speed skaters and hockey players and, for an inward tilt, it will provide additional traction for hockey players digging into the ice to race to a puck or with the puck toward the net in a breakaway. This same benefit will be provided the speed skater during her/his initial sprint start. By rotating her/his ankles inwardly through 45°, the hockey player or speed skater will cause both first secondary blade 28 and primary blade 26 to engage the ice in a manner to significantly increase traction.

Figure 2:
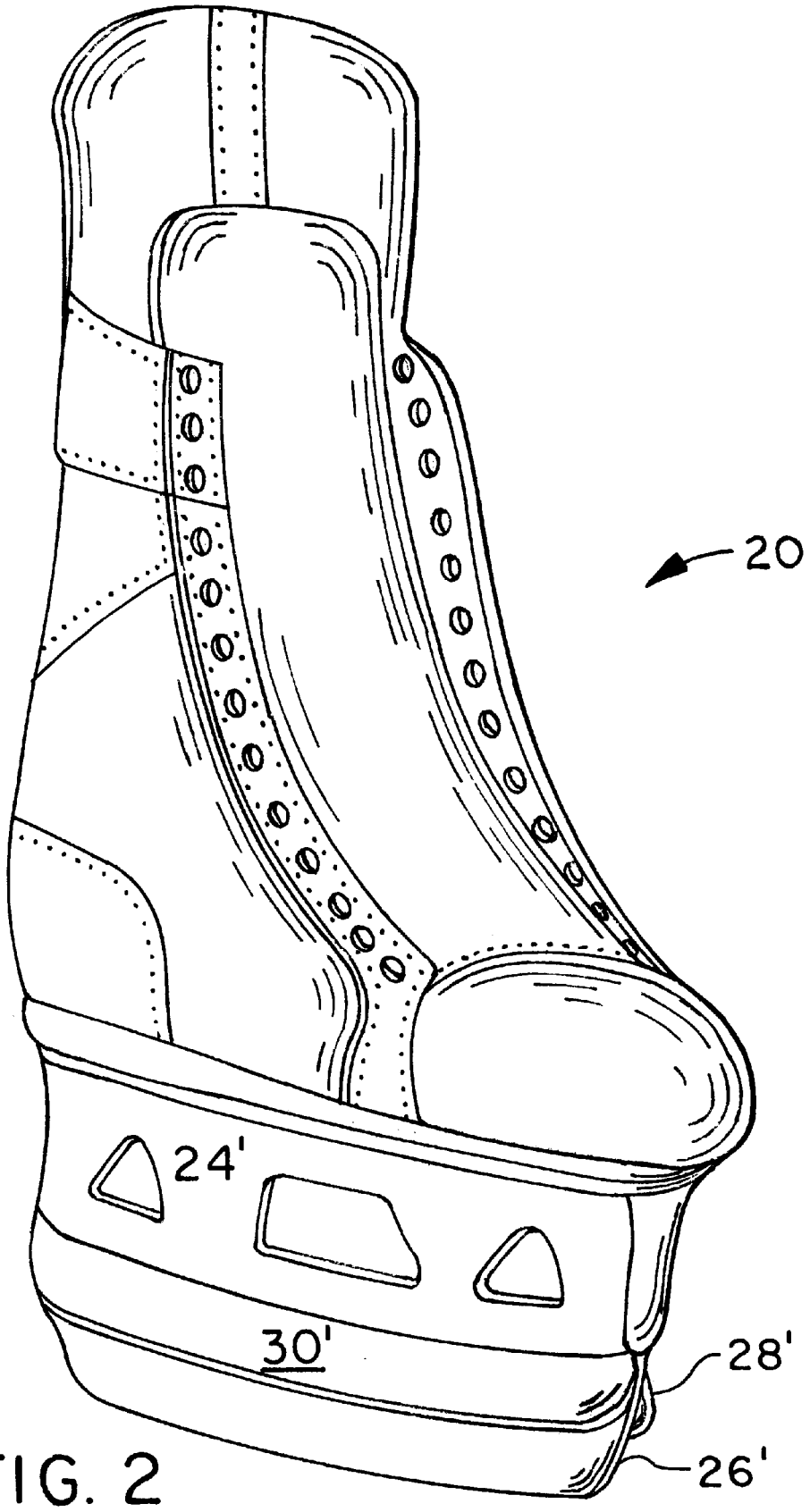
FIG. 2 is a front perspective view of a second embodiment of the multiple-blade skate of the present invention.
Figure 3B:
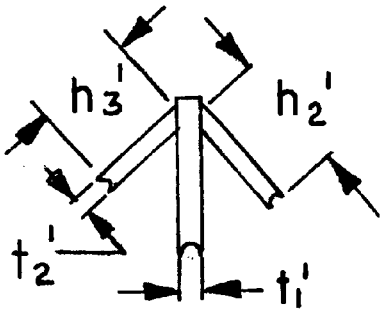
FIG. 3B is a front view of the blade configuration of the second embodiment.
Figure 3C:
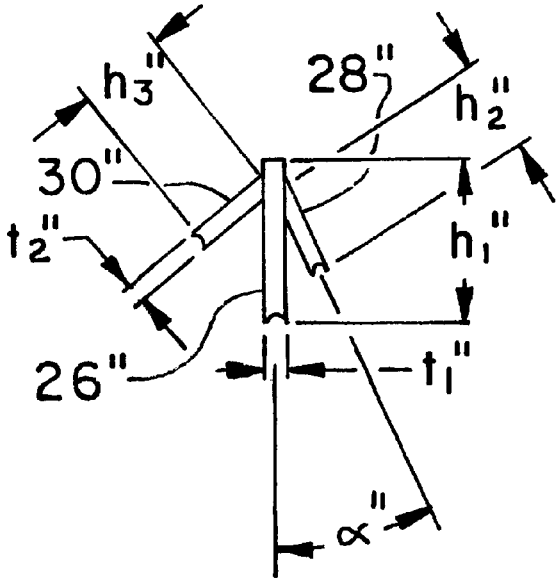
FIG. 3C is a front view of a second alternative blade configuration for the second embodiment.

A second embodiment of the present invention is shown in FIG. 2 generally at 20'. It will be appreciated that for some applications, it may be beneficial for $\gamma$ and $\delta$, the angles at which the first, or inner, blade 28' engages the ice and the second, or outer, blade 30' engages the ice, to be different. For example, for the sprint application, perhaps a third predetermined angle $\gamma$ of 30° would be preferable so double blade engagement could occur without having to roll ones ankles inwardly so severely, while the outer stabilizing blade 30' remains at 45°. This could be produced in either of two ways. The angle $\alpha$ could be maintained at 45° and the height of blade 30' could be extended to the point that $\gamma$ equals 30°, as shown in FIG. 3B. This would require a 26.8% increase in blade length Alternatively, the angle $\alpha$ can be changed to, say 30°, and the length $h_2$" varied to produce the desired angle of engagement $\gamma$ of 30°, as seen in FIG. 3C. This will result in a change in the height $h_2$" of 21.9%. This will save some money in material cost and is therefore preferred.

The improved speed/hockey skate 20 of the present invention provides first (28) and second (30) secondary blades to provide auxiliary lateral stability in the event the angles $\gamma$ or $\delta$ formed by primary blade 26 exceed a predetermined angle which would permit slippage to occur were secondary blades 28, 30 not present. In addition, inner blade 28 provides additional traction for sprint situations to accelerate from a stand still to maximum speed over short distances. Secondary blades 28, 30 may be welded or otherwise attached directly to the lateral faces of primary blade 26 or attached to the sides of blade support 24. In a first preferred embodiment, secondary blades 28, 30 have the same height and are positioned at equal angles $\alpha$ and $\beta$ of say 45° and will engage the ice when primary blade 26 is tilted through a similar angle. In a second preferred embodiment, the inner blade 28 is positioned at a lesser angle $\alpha$ of say 30°, while outer blade 30 remains at an angle $\beta$ of 45°, to permit secondary blade 28 to engage the ice simultaneously with blade 26 with less of an ankle rotation being required. It will of course, be understood that it is within the scope of the invention for the inner angle $\alpha$ to be greater than the outer angle $\beta$ should improved stability or other reasons dictate such a configuration.

Various changes, alternatives and modifications will become apparent to one of ordinary skill in the art following a reading of the foregoing specification. It is intended that any such changes, alternatives and modifications as fall within the scope of the appended claims be considered part of the present invention.

I claim:

1. Ice skates comprising a) a pair of skate blade assemblies, each assembly including i) a blade support to which a primary blade and a pair of secondary blades are attached;

ii) a primary blade having a first mean blade thickness and a first height, iii) first and second secondary blades which each have a second mean blade thickness substantially equal to said first mean blade thickness, said first and second secondary blades each being attached directly to and extending angularly outwardly from opposing lateral faces of said primary blade at first and second predetermined angles;

b) means to attach a pair of said blade assemblies to right and left feet of a wearer, respectively;

whereby when at least one of said primary blades of said pair of primary blades is in contact with and extends at a third predetermined angle with an ice surface, said first secondary blade will come in contact with the ice surface and when at least one of said primary blades is in contact with and extends at a fourth predetermined angle with the ice surface, said second secondary blade will come in contact with the ice surface, said first and second secondary blades providing auxiliary support significantly reducing a risk of a fall resulting from said primary blade slipping laterally on the ice surface.

2. The ice skates of claim 1 wherein said first and second predetermined angles are equal.

3. The ice skates of claim 2 wherein said first and second predetermined angles are preferably each 45°.

4. The ice skates of claim 3 wherein said first secondary blade has a second height and said second secondary blade has a third height substantially equal to said second height.

5. The ice skates of claim 4 wherein said third and fourth predetermined angles are substantially equal.

6. The ice skates of claim 5 wherein said third and fourth predetermined angles substantially equal 45°.

7. The ice skates of claim 3 wherein said first secondary blade is an inner blade and has a second height and said second secondary blade is an outer blade and has a third height which is less than said second height.

8. The ice skates of claim 7 wherein said third and fourth predetermined angles are unequal.

9. The ice skates of claim 8 wherein said third predetermined angle is preferably 30° and said fourth predetermined angle is preferably 45°.

10. The ice skates of claim 1 wherein said first and second predetermined angles are unequal.

11. The ice skates of claim 10 wherein said first predetermined angle is preferably 30° and said second predetermined angle is preferably 45°.

12. The ice skates of claim 1 wherein said means to attach said pair of blade assemblies to the right and left feet of the wearer, respectively, comprises a pair of laceable shoes to each one of which one of said pair of blade supports is attached.

13. The ice skates of claim 1 wherein said third and fourth predetermined angles are substantially equal.

14. The ice skates of claim 13 wherein said third and fourth predetermined angles substantially equal 45°.

* * * * *